US012635773B2

(12) United States Patent
Fischer

(10) Patent No.: US 12,635,773 B2
(45) Date of Patent: May 26, 2026

(54) UMBRELLA COMPRISING AN ILLUMINATION FEATURE AND METHODS OF MAKING AND USING THE SAME

(71) Applicant: Clyne Christopher Fischer, Summerville, SC (US)

(72) Inventor: Clyne Christopher Fischer, Summerville, SC (US)

( * ) Notice: Subject to any disclaimer, the term of this patent is extended or adjusted under 35 U.S.C. 154(b) by 283 days.

(21) Appl. No.: 18/290,272

(22) PCT Filed: Apr. 14, 2022

(86) PCT No.: PCT/US2022/024724
§ 371 (c)(1),
(2) Date: Nov. 10, 2023

(87) PCT Pub. No.: WO2022/250800
PCT Pub. Date: Dec. 1, 2022

(65) Prior Publication Data

US 2024/0237791 A1 Jul. 18, 2024

Related U.S. Application Data

(60) Provisional application No. 63/258,771, filed on May 27, 2021.

(51) Int. Cl.
*A45B 9/02* (2006.01)
*A45B 3/04* (2006.01)

(52) U.S. Cl.
CPC ..... *A45B 9/02* (2013.01); *A45B 3/04* (2013.01); *A45B 2200/1018* (2013.01)

(58) Field of Classification Search
CPC ..... A45B 2200/1018
See application file for complete search history.

(56) References Cited

U.S. PATENT DOCUMENTS 2,507,919 A * 5/1950 Mazzeo ..... A45B 3/04 135/910
4,962,779 A * 10/1990 Meng ..... A45B 25/24 135/910

(Continued)

FOREIGN PATENT DOCUMENTS

GB 2533509 A * 6/2016 ..... A45B 3/04

OTHER PUBLICATIONS

PCT International Preliminary Report on Patentabilty.

*Primary Examiner* — Noah Chandler Hawk
(74) *Attorney, Agent, or Firm* — Ashley D. Johnson; Dogwood Patent and Trademark Law

(57) ABSTRACT

The invention is a solar and/or battery powered umbrella with a light directing enhancement. Specifically, the umbrella is configured to provide a light within the inside of the umbrella canopy, while also being capable of use as a handheld flashlight. The umbrella includes a handle comprising a grip that allows the user to hold and maneuver the umbrella, as well as control and operate the light source. The umbrella also includes an illuminator positioned above the handle, adjacent to the umbrella canopy. An inner covering is provided to block user light exposure when the illuminator is in use. Advantageously, the disclosed umbrella allows a user to see in the dark while it is raining, and also provides a convenient storage option for both an umbrella and flashlight.

15 Claims, 10 Drawing Sheets

(56) References Cited

U.S. PATENT DOCUMENTS

| | | | | |
|---|---|---|---|---|
| 4,989,123 | A * | 1/1991 | Best | A45B 3/04 135/910 |
| 10,561,210 | B1 * | 2/2020 | Huang | H05B 45/20 |
| 12,038,167 | B2 * | 7/2024 | Chen | A45B 25/06 |
| 2004/0228118 | A1 | 11/2004 | Peterson | |
| 2006/0245184 | A1 * | 11/2006 | Galli | F21V 9/08 362/208 |
| 2010/0269870 | A1 * | 10/2010 | You | A45B 3/04 135/16 |
| 2013/0128496 | A1 * | 5/2013 | Chien | A45B 23/00 362/102 |
| 2013/0148334 | A1 * | 6/2013 | Chen | A45B 3/04 362/102 |
| 2014/0305477 | A1 | 10/2014 | Zemach | |
| 2023/0033371 | A1 * | 2/2023 | Chen | F21V 23/04 |
| 2023/0371665 | A1 * | 11/2023 | Chen | H02J 7/0063 |

* cited by examiner

UMBRELLA COMPRISING AN ILLUMINATION FEATURE AND METHODS OF MAKING AND USING THE SAME

CROSS-REFERENCE TO RELATED APPLICATIONS

This application claims priority to U.S. Provisional Patent Application No. 63/258,771, filed May 27, 2021 and PCT International Application No. PCT/US22/24724, filed Apr. 14, 2022, the entire content of which are hereby incorporated by reference.

TECHNICAL FIELD

The presently disclosed subject matter relates an umbrella that includes an illumination feature, and to methods of using the disclosed umbrella.

BACKGROUND

Walking and moving outside after dark can be especially dangerous in rainy conditions due to low visibility. Specifically, it is often difficult for a person to walk outdoors safely, especially in areas and/or along pathways that may not be illuminated by streetlights or other similar outdoor lighting. While a person might opt to protect themselves from falling rain with a portable and personal hand-held umbrella, darkness can still make walking on uneven ground treacherous. One possible solution is for the person to carry a separate flashlight to help illuminate their path and/or immediate area to make walking on uneven ground safer. However, using a flashlight while also holding an umbrella and one or more other items (e.g., purse, phone, shopping bags) can further complicate the situation. For example, use of a flashlight and an umbrella would in most instances involve use of both hands. Further, the individual frequently may need to locate carried items, such as keys, phone, and the like. Attempting to locate these items while also struggling with an umbrella and a separate flashlight can be difficult to manage without dropping one or more items, causing damage. It would therefore be beneficial to provide an umbrella with an illumination feature.

SUMMARY

In some embodiments, the presently disclosed subject matter is directed to an illuminating umbrella. The umbrella comprises an elongated handle comprising a first end, an opposed second end, an exterior, and an interior. The umbrella further includes a folding radial frame positioned at the first end of the handle, the frame defined by a series of outer ribs and inner ribs. The umbrella includes a canopy extending over the frame, directly attached to the outer ribs, and a grip positioned at the second end of the handle, the grip defined by a bottom surface. The umbrella comprises an illuminator positioned around the exterior of the handle, below the folding radial frame. The illuminator is defined by first and second inner chambers, each comprising one or more sections that are transparent, opaque, or semi-transparent. The illuminator includes a light source positioned within the second chamber, a top hinge positioned adjacent to a top edge of the first chamber, and an iris cover positioned adjacent to the top hinge. The iris cover is defined by upper and lower segments each comprising a central opening, wherein the upper and lower segments join to create an interior. The iris cover also includes a lens positioned within the interior, aligned with the central openings. The iris cover includes a regulator positioned within the interior comprising a window that opens and closes, aligned with the central openings. The illuminator comprises a casing positioned adjacent to a lower end of the second chamber, a lower hinge positioned adjacent to the casing, a nook positioned adjacent to the lower hinge, the nook comprising a diameter that is less than a diameter of the lower hinge, and a base positioned adjacent to the nook, the base having a diameter that is greater than the diameter of the nook. The umbrella includes an inner covering that spans a distance extending from the inner ribs, across the illuminator at a level that is above the light source, down the length of the ribs to encircle the nook, thereby enclosing the light source.

In some embodiments, the light source comprises one or more light emitting diodes.

In some embodiments, the bottom surface of the grip comprises one or more solar panels configured to charge the light source.

In some embodiments, the umbrella includes batteries configured to charge the light source.

In some embodiments, wiring extends from the light source through the interior of the handle to one or more batteries, solar panels, or both.

In some embodiments, the interior surface of the upper and lower chambers comprises a reflective material.

In some embodiments, the light source emits light in white, yellow, blue, red, green, orange, purple, or combinations thereof.

In some embodiments, the umbrella further includes a dimmer to adjust intensity of light emitting from the light source.

In some embodiments, the upper chamber is opaque, and all but a section of the lower chamber is opaque.

In some embodiments, the umbrella includes a USB port, mini-USB port, or both.

In some embodiments, the presently disclosed subject matter is directed to a method of illuminating the interior of an umbrella. Specifically, the method comprises initiating the light source of an illuminating umbrella. The umbrella comprises an elongated handle comprising a first end, an opposed second end, an exterior, and an interior. The umbrella further includes a folding radial frame positioned at the first end of the handle, the frame defined by a series of outer ribs and inner ribs. The umbrella includes a canopy extending over the frame, directly attached to the outer ribs, and a grip positioned at the second end of the handle, the grip defined by a bottom surface. The umbrella comprises an illuminator positioned around the exterior of the handle, below the folding radial frame. The illuminator is defined by first and second inner chambers, each comprising one or more sections that are transparent, opaque, or semi-transparent. The illuminator includes a light source positioned within the second chamber, a top hinge positioned adjacent to a top edge of the first chamber, and an iris cover positioned adjacent to the top hinge. The iris cover is defined by upper and lower segments each comprising a central opening, wherein the upper and lower segments join to create an interior. The iris cover also includes a lens positioned within the interior, aligned with the central openings. The iris cover includes a regulator positioned within the interior comprising a window that that opens and closes, aligned with the central openings. The illuminator comprises a casing positioned adjacent to a lower end of the second chamber, a lower hinge positioned adjacent to the casing, a nook positioned adjacent to the lower hinge, the nook comprising a diameter that is less than a diameter of the lower hinge, and a base positioned adjacent to the nook, the base having a diameter that is greater than the diameter of the nook. The umbrella includes an inner covering that spans a distance extending from the inner ribs, across the illuminator at a level that is above the light source, down the length of the ribs to encircle the nook, thereby enclosing the light source. The method includes extending the umbrella to a use configuration wherein the canopy is fully extended, whereby light produced by the light source extends through at least a portion of the lower chamber to illuminate the interior of the umbrella, under the canopy.

In some embodiments, the intensity of the light is adjusted by a dimmer switch positioned on the illuminating umbrella.

In some embodiments, the light source comprises one or more light emitting diodes.

In some embodiments, the presently disclosed subject matter is directed to a method of using a flashlight, the method comprising initiating the light source of an illuminating umbrella. Specifically, the illuminating umbrella is defined by an elongated handle comprising a first end, an opposed second end, an exterior, and an interior. The umbrella further includes a folding radial frame positioned at the first end of the handle, the frame defined by a series of outer ribs and inner ribs. The umbrella includes a canopy extending over the frame, directly attached to the outer ribs, and a grip positioned at the second end of the handle, the grip defined by a bottom surface. The umbrella comprises an illuminator positioned around the exterior of the handle, below the folding radial frame. The illuminator is defined by first and second inner chambers, each comprising one or more sections that are transparent, opaque, or semi-transparent. The illuminator includes a light source positioned within the second chamber, a top hinge positioned adjacent to a top edge of the first chamber, and an iris cover positioned adjacent to the top hinge. The iris cover is defined by upper and lower segments each comprising a central opening, wherein the upper and lower segments join to create an interior. The iris cover also includes a lens positioned within the interior, aligned with the central openings. The iris cover includes a regulator positioned within the interior comprising a window that opens and closes, aligned with the central openings. The illuminator comprises a casing positioned adjacent to a lower end of the second chamber, a lower hinge positioned adjacent to the casing, a nook positioned adjacent to the lower hinge, the nook comprising a diameter that is less than a diameter of the lower hinge, and a base positioned adjacent to the nook, the base having a diameter that is greater than the diameter of the nook. The umbrella includes an inner covering that spans a distance extending from the inner ribs, across the illuminator at a level that is above the light source, down the length of the ribs to encircle the nook, thereby enclosing the light source. The method includes retracting the illuminating umbrella to a storage configuration wherein the canopy and upper and lower ribs are fully folded. The method includes opening the window of the actuator to allow light to pass from the light source, through the interior of the upper and lower chambers, through the opening of the iris covering, through the lens, to exit the second iris covering segment, wherein the light that exits the iris covering functions as a flashlight beam.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
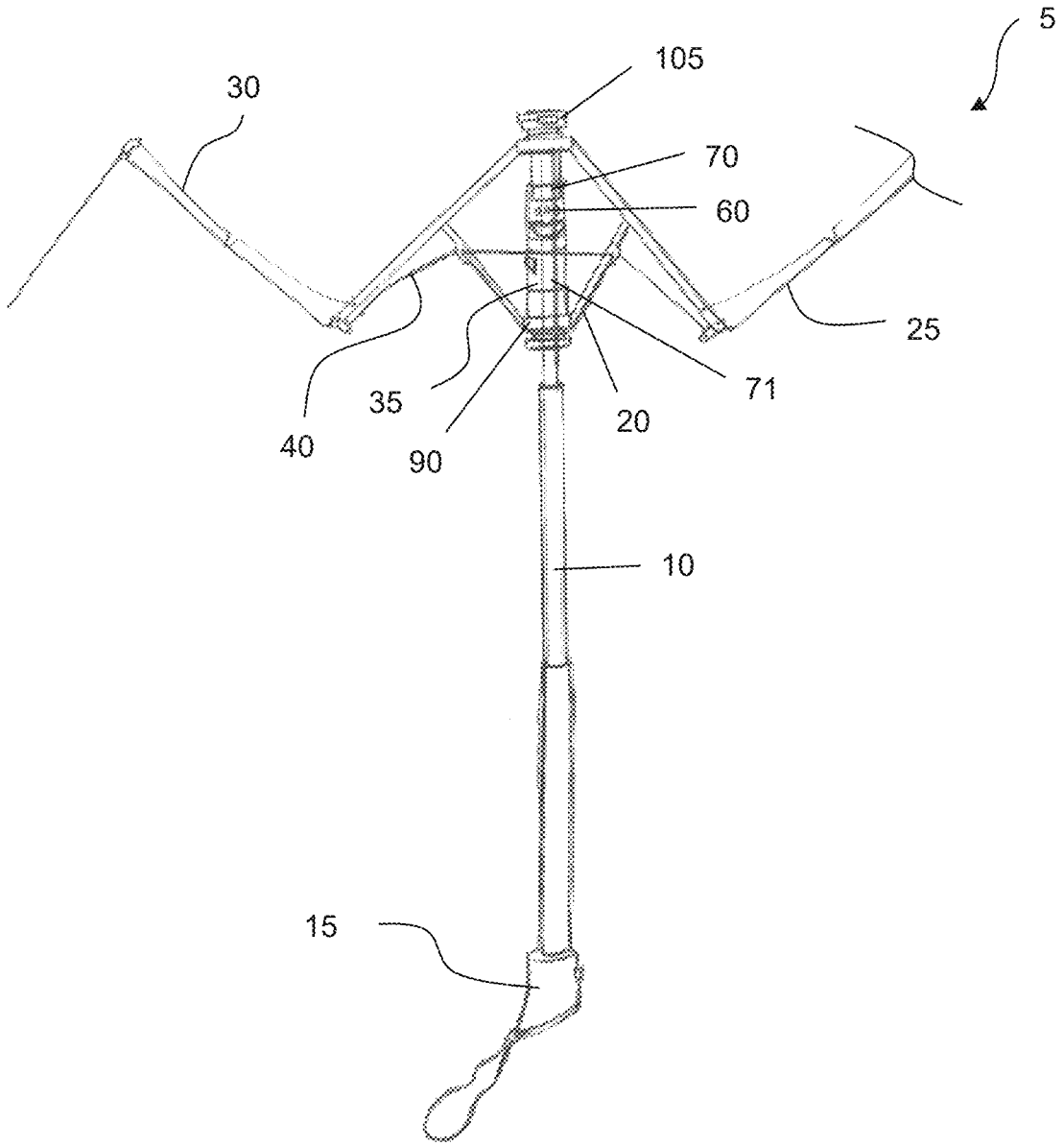
FIG. 1 is a front plan view of an illuminating umbrella in accordance with some embodiments of the presently disclosed subject matter.

The presently disclosed subject matter is directed to solar and/or battery powered umbrella with a light directing enhancement. Specifically, the disclosed umbrella is configured to provide a light within the inside of the umbrella canopy, while also being capable of use as a handheld flashlight. FIG. 1 illustrates one embodiment of umbrella 5 in a partially extended orientation. As shown, the umbrella includes elongated handle 10 comprising grip 15 that allows the user to hold and maneuver the umbrella. The device also includes a series of inner ribs 20 that cooperate with outer ribs 25 to provide structure and support to umbrella canopy 30. The umbrella also includes illuminator 35 positioned above the handle, adjacent to the umbrella canopy. Inner covering 40 is provided to block user light exposure when the illuminator is in use. Advantageously, the disclosed umbrella allows a user to see in the dark while it is raining, and also provides a convenient storage option for both an umbrella and flashlight.

Figure 2A:
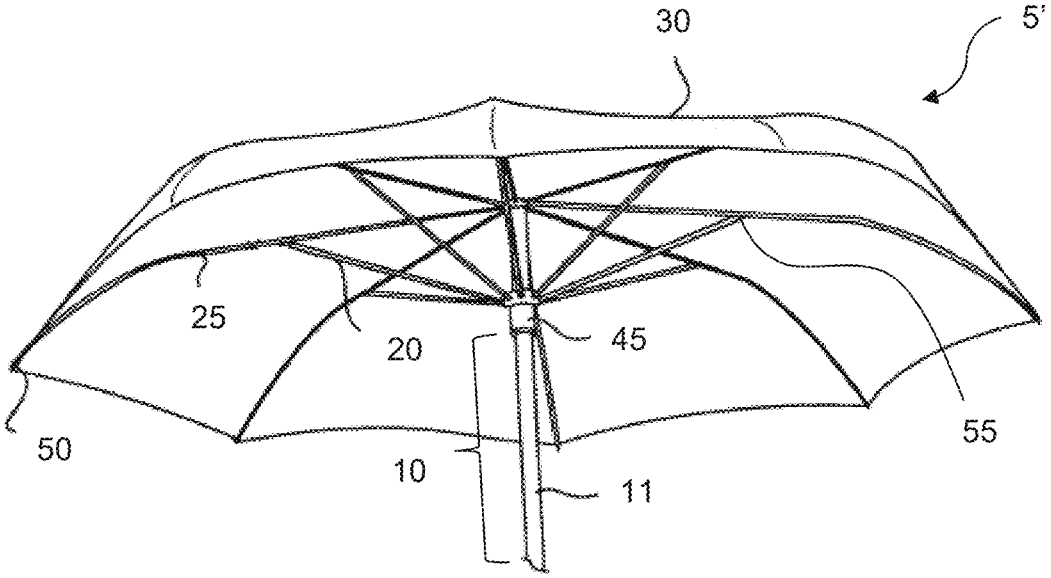
FIG. 2*a* is a perspective view of an umbrella in an open configuration in accordance with some embodiments of the presently disclosed subject matter.

FIG. 2*a* illustrates one embodiment of a conventional retractable umbrella 5'. The term "retractable" refers the characteristic of the umbrella being convertible between the open, extended orientation of FIG. 2*a* and the closed orientation of FIG. 2*b*. The term "retractable umbrella" can include beach umbrellas and personal umbrellas. As shown, umbrella 5' includes handle 10 that can include one or more segments 11. In some embodiments, the segments can be telescoping, allowing handle 10 to be collapsed when not in use. In other embodiments, the handle includes a single elongated segment that is not retractable. A grip is provided at the distal end of the handle to facilitate maneuvering and use of the umbrella.

The umbrella further includes sliding ring 45 mounted on the handle. The sliding ring facilitates the opening and closing of the umbrella. Particularly, the sliding ring can move up and down the handle to adjust the canopy between a closed position when the sliding ring moves to the lowest point on the handle and a fully opened canopy when sliding ring 45 is at its highest point on the handle. The sliding ring can be locked into position using any suitable mechanism, such as the use of a spring-loaded detent that engages an opening formed in the handle.

Umbrella 5' includes outer ribs 25 and inner ribs 20 that provide structure and shape to the umbrella. Outer ribs 25 hold up the canopy in the open configuration. Inner ribs 20 act as supports and connect the outer ribs to the umbrella handle. The ribs cooperate in a folding construction to support the canopy. Specifically, each outer rib includes first end 26 that is pivotally attached to cap 27 and opposed second end 28 that attaches to canopy 30 using any suitable mechanism. The pivotal characteristic of the outer rib first end allows the ribs to pivot between a fully closed position and a fully open position.

Inner ribs 20 also include first end 31 that is pivotally attached to sliding ring 45 and second end 32 that is attached to a corresponding outer rib at joint 55. Attachment at joint 55 can be accomplished using any suitable mechanism, such as fasteners, clips, welding, adhesive, and the like.

The disclosed canopy can include any number of outer and/or inner ribs, such as about 3-10 or more. In some embodiments, there are equal numbers of inner and outer ribs 20, 25. In other embodiments, there are more outer ribs than inner ribs.

In the use orientation of FIG. 2*a*, the umbrella is in an opened state to protect the user from rain and other adverse weather conditions. The handle is in an upright position and canopy 30 is located at or near the top of the umbrella. The term "canopy" refers to the protective portion of the umbrella that functions to catch rain, wind, hail, and the like. The canopy can be constructed from fabric, plastic, and the like and in some embodiments can be waterproof. Canopy 30 further can be constructed in any color, pattern, shape, or combinations thereof.

Figure 2B:
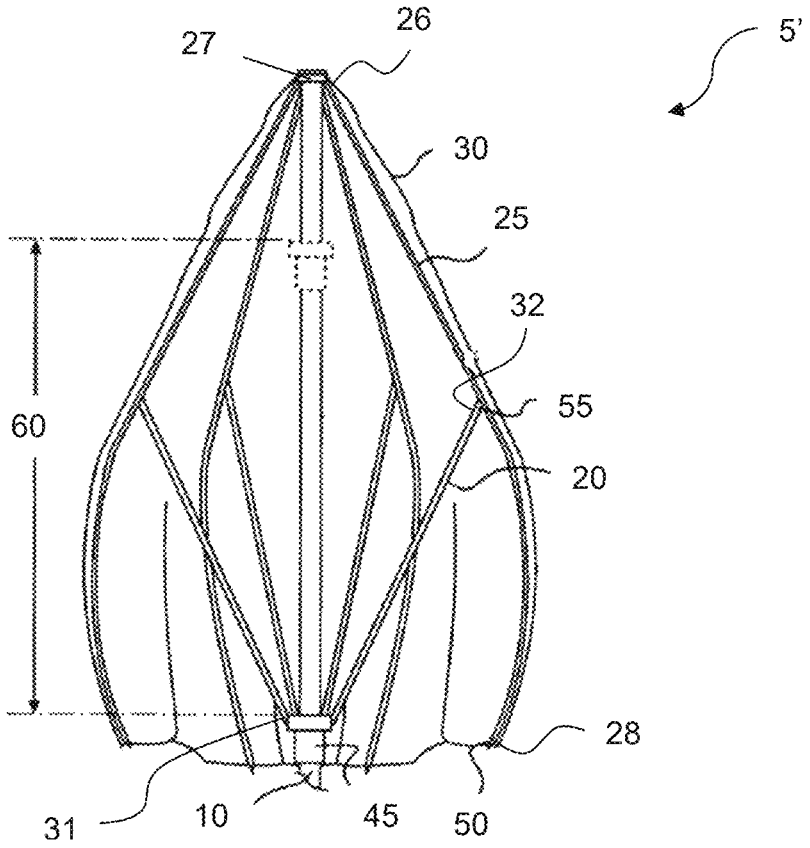
FIG. 2*b* is a side plan view of an umbrella in a closed configuration in accordance with some embodiments of the presently disclosed subject matter.

To open umbrella 5', sliding ring 45 is pushed upward from a position near the bottom of the umbrella handle (shown by distance 60 in FIG. 2*b*) to a position near the top of the umbrella. To close the umbrella, ring 45 is pulled downward from the position near the top of the umbrella to the position near the bottom of the umbrella handle. Thus, to open or close umbrella 5, a user can raise or lower the sliding ring as desired. It should be appreciated that the umbrella illustrated in FIGS. 2*a* and 2*b* is merely one example of an umbrella that can be used in the presently disclosed subject matter. The disclosed umbrella can include one or more features of umbrella 5'.

Figure 3A:
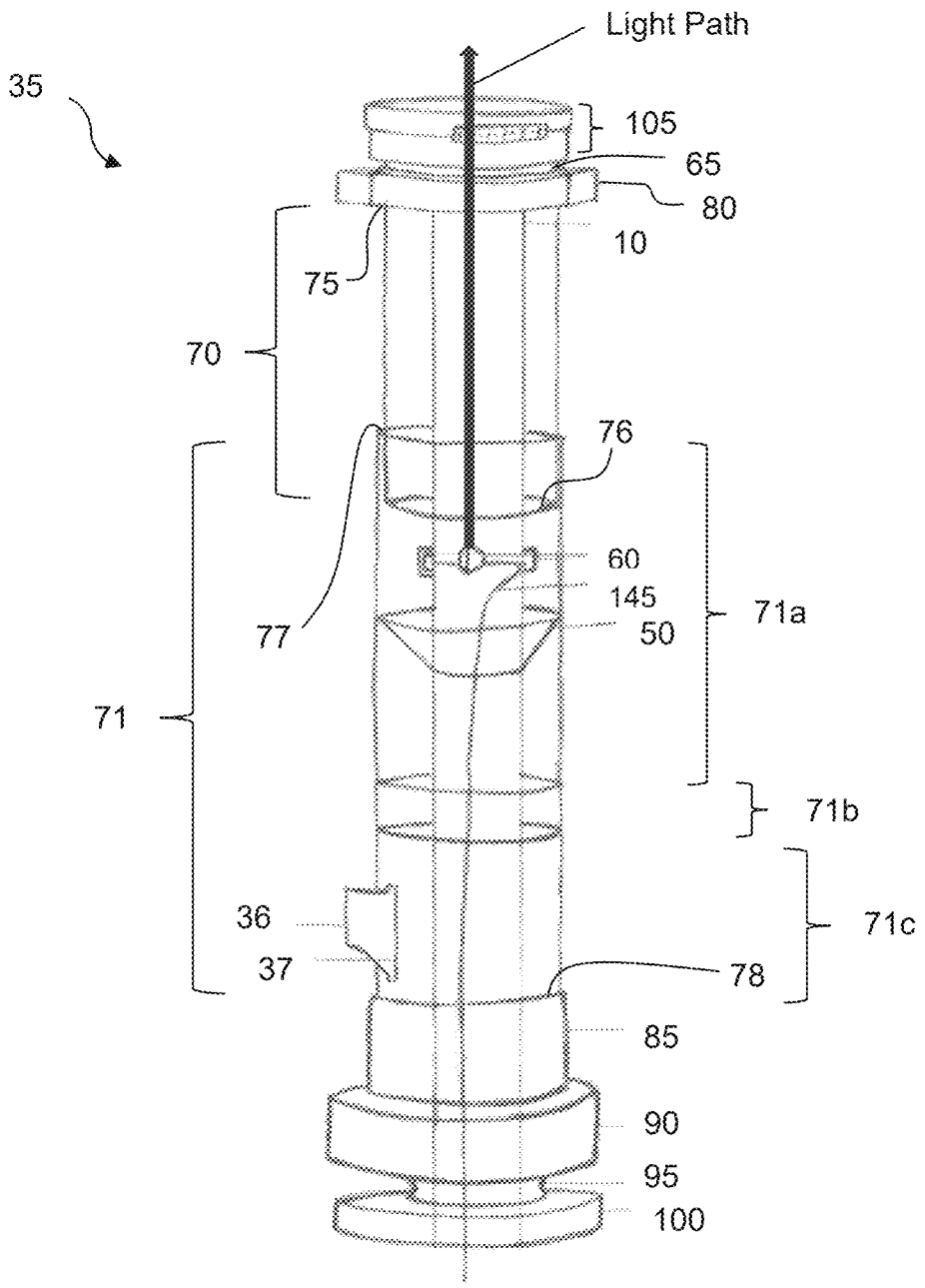
FIG. 3*a* is a front plan view of an illuminator in accordance with some embodiments of the presently disclosed subject matter.

The disclosed umbrella includes illuminator 35 positioned between the top of the umbrella (adjacent to the canopy) and the middle and lower regions of the umbrella. The term "illuminator" refers to any light source that is used to illuminate a surface or area, such as (but not limited to) a flashlight, bulbs, or any other source of illumination. FIG. 3*a* illustrates one embodiment of the illuminator comprising one or more light sources 60. The term "light source" can include one or more light emitting diodes (LEDs), laser diodes (LD), organic light-emitting diodes (OED), liquid crystal displays (LCD), incandescent bulbs, halogen bulbs, compact fluorescent lights (CFLs), or any other suitable source configured to provide light. The light source can be of any desired wavelength range in the visible and infrared regions (e.g., about 380-740 nanometers).

Light source 60 can be configured to emit light of any color, such as (but not limited to) white, yellow, blue, red, green, orange, purple, and the like. In some embodiments, combinations of colors can be emitted (e.g., a first LED emits light of a first color while a second LED emits light of a different color). The intensity of the light can also be adjusted as desired by the user, such as through dimmer 65. In use, the dimmer can be manually adjusted to increase or decrease the brightness of the light source. Any suitable dimmer can be used, such as those that are adjusted by the turning of a knob, moving a slider, and the like.

Light source 60 is covered by first and second double hollow chambers 70, 71. The first chamber includes top end 75 that is disposed adjacent to top hinge 80. The first chamber further includes bottom end 76 that is disposed within the interior of second chamber 71. Similarly, second chamber includes top end 77 and opposed bottom end 78 positioned adjacent to casing 85. In some embodiments, the first and second chambers are constructed from a transparent material, such as glass, plexiglass, plastic, and the like. The term "transparent" refers to a material that transmits at least 50% of incident light in the visible range directed to one side of the material to the other side of the material (e.g., allowing light to pass through so that an observer can clearly see the interior of the chamber). In other embodiments, all or a portion of one or both chambers can be semi-transparent or opaque. The term "semi-transparent" refers to an intermediate state between transparent and opaque. The term "opaque" refers to a material that presents a substantial barrier to the transmission of light (e.g., 90% or more of incident light is blocked). In some embodiments, one or both chambers can include two or more sections that vary in transparency. For instance, chamber 71 can include sections 71*a*, 71*b*, and 71*c*. All or portions of chambers 70, 71 can be transparent, semi-transparent, or opaque. Thus, in some embodiments, chamber 70 and sections 71*a* and 71*c* can be opaque while section 71*b* can be transparent or semi-transparent. However, it should be appreciated that the presently disclosed subject matter is not limited and chambers 70, 71 or sections 71*a*, 71*b*, or 71*c* can each independently be transparent, semi-transparent, or opaque. In some embodiments, opaque chambers or sections can include reflective interior portions to direct produced light and prevent light from escaping if the umbrella is not fully opened.

Figure 3B:
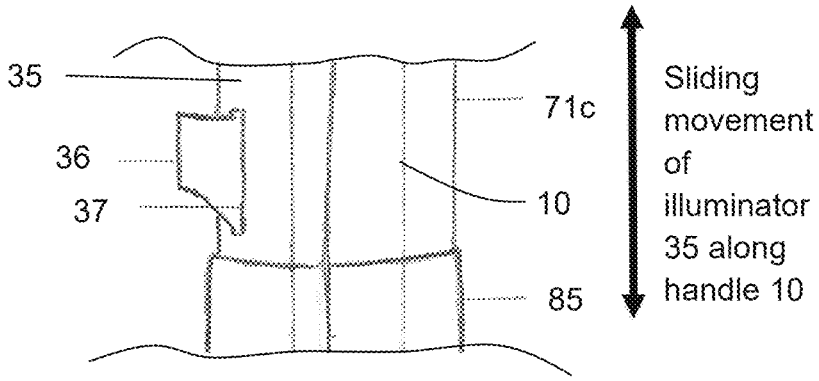
FIG. 3*b* is a fragmentary front plan view of an illuminator in accordance with some embodiments of the presently disclosed subject matter.

Casing 85 functions to retain second chamber 71 using any suitable mechanism (e.g., adhesive, welding, snap-fit, pressure-fit, screws, fasteners, clips). The casing connects to lower hinge 90 that attaches to second end 31 of the inner ribs. Covering nook 95 is positioned between the lower hinge and upper chamber base 100. Thus, illuminator 35 functions as a sliding ring, moving up and down the handle to open and close the umbrella canopy. The umbrella can be expanded or condensed by moving retractable hinge 36 from retractable hinge slit 37, as shown in FIG. 3*b*.

Figure 4A:
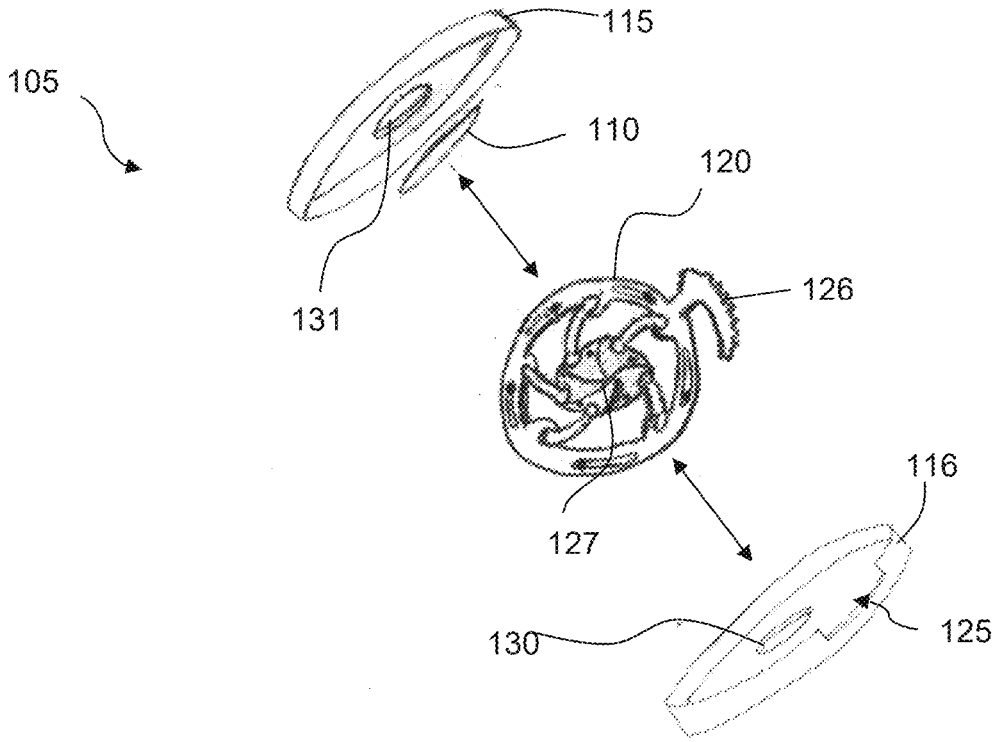
FIG. 4*a* is an exploded perspective view of an iris cover in accordance with some embodiments of the presently disclosed subject matter.
Figure 4B:
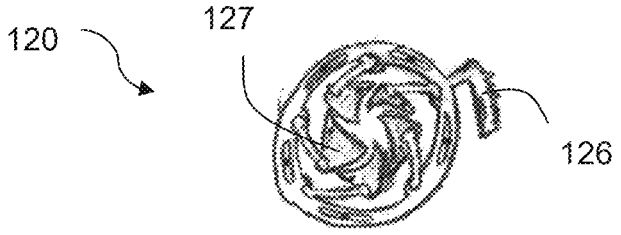
FIGS. 4*b* and 4*c* are top plan views of iris cover adjusters in partially open and open configurations in accordance with some embodiments of the presently disclosed subject matter.
Figure 4C:
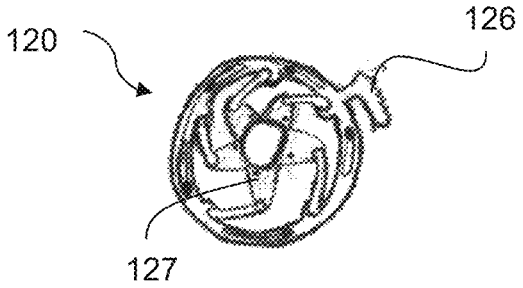

The top of the illuminator includes iris cover 105 comprising an interior flashlight lens 110 that can be opened or closed, enabling the umbrella to be used as a flashlight. As shown in FIG. 4*a*, the cover includes upper and lower segments 115, 116 that join together to house lens 110 and regulator 120. The upper and lower segments can be joined using any suitable mechanism. The term "lens" refers to an object through which light rays are focused or otherwise projected to form an image. The regulator can be adapted from the closed orientation of FIG. 4*a* to the partially open and fully open configurations of FIGS. 4*b* and 4*c*, respectively. Any mechanism can be used to alter the regulator. For example, lower segment 116 can include opening 125 through which arm 126 can extend when the iris cover is assembled. A user can manipulate the arm to thereby open and close screen 127 to block, partially block, or allow access to lens 110. Light therefore travels from the light source through entry opening 130 in lower segment 116 and is controlled by regulator 126, such that the light travels through, partially travels through, or is blocked from reaching lens 110 and passing out through exit opening 131. In this way, the iris cover can be opened and closed, allowing the umbrella to be used as a flashlight.

In some embodiments O-ring 135 is positioned between iris cover 105 and top hinge 80. When the O-ring is compressed between the iris cover and the to hinge, it blocks the passage of light, gas, or fluid. Thus, the O-ring can function as a seal between the top hinge and the iris cover.

Figure 5A:
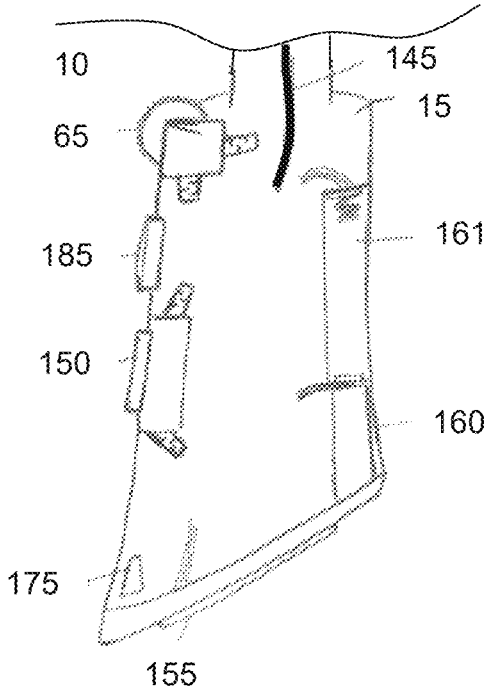
FIG. 5*a* is a side plan view of an illuminating umbrella grip in accordance with some embodiments of the presently disclosed subject matter.

The umbrella includes handle 110 positioned interior to first and second chambers 70, 71. The handle can be configured as a hollow shaft. In some embodiments, the handle travels the full length of the umbrella, from adjacent to the canopy to grip 15. In some embodiments, wiring 145 for light source 60 can travel within the interior of hollow handle 10, as shown in FIG. 3*a*. The wiring can extend through the handle to grip 15, as illustrated in FIG. 5*a*. The wiring can be controlled by on/off button 150 or in line rotary dimmer switch 65.

Figure 5B:
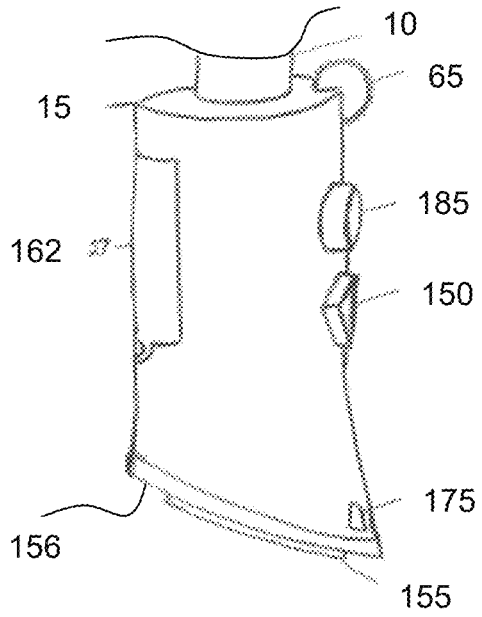
FIG. 5*b* is a side plan view of an illuminating umbrella grip in accordance with some embodiments of the presently disclosed subject matter.
Figure 5C:
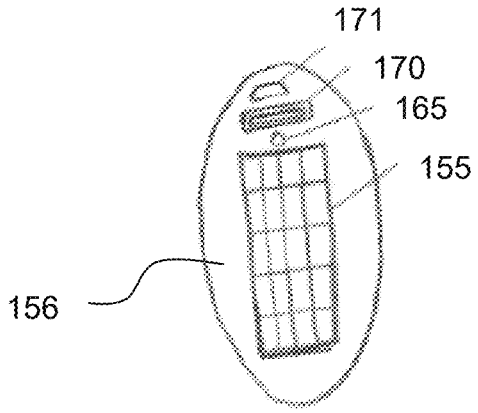
FIG. 5*c* is a bottom plan view of an illuminating umbrella grip in accordance with some embodiments of the presently disclosed subject matter.

The illuminator can be powered by solar power through panels 155 positioned on bottom handle edge 156 as shown in FIGS. 5*a* and 5*b*. The charge from the solar panel can be stored in an internal lithium-ion battery 160. The battery is held in position via holder 161 and maintained within the interior of the grip using removable cover 162. FIG. 5*c* illustrates one embodiment of the bottom handle edge, comprising panels 155 with optional battery indicator light 165 to indicate the amount of charge left in the battery. In some embodiments, the umbrella handle can include USB port 170 and/or mini-port 171 to facilitate charging of the internal lithium ion battery. In some embodiments, the battery can be configured to charge other small devices for future use.

In some embodiments, a charging cord can be added to umbrella 5 by plugging it in or inserting a retractable USB cord.

Figure 5D:
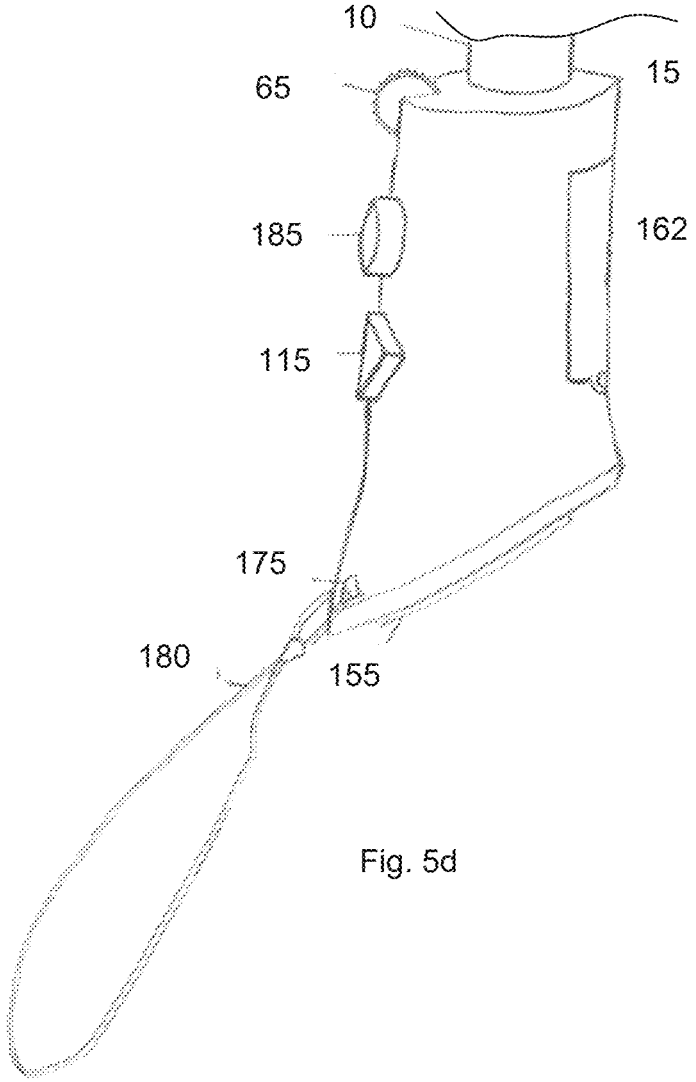
FIG. 5*d* is a side plan view of an illuminating umbrella grip comprising a strap in accordance with some embodiments of the presently disclosed subject matter.

Optionally, the handle can comprise aperture 175 for easily and securing wrist strap 180 or other hanging mechanism, as shown in FIG. 5*d*. In this way, the umbrella can be hung when not in use with solar panel 155 exposed to sunlight.

Figure 6A:
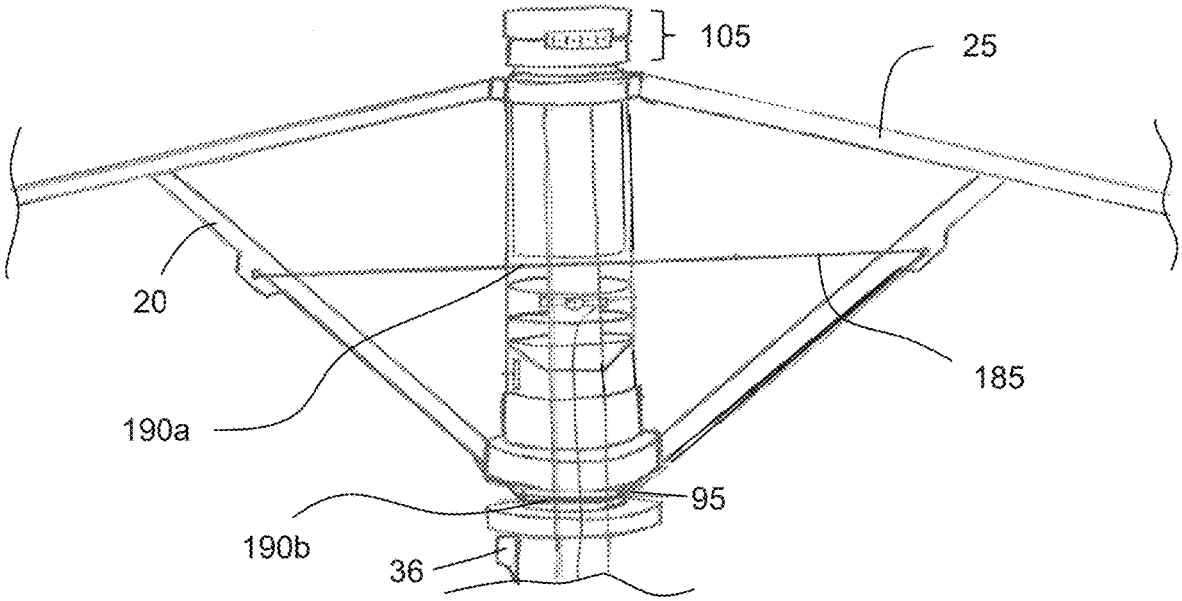
FIG. 6*a* is a fragmentary front plan view of an illuminating umbrella comprising an extended inner covering in accordance with some embodiments of the presently disclosed subject matter.

The disclosed umbrella can include inner covering 185 positioned above light source 60 to block direct light to the user positioned below the umbrella canopy, as shown in FIG. 6*a*.

Figure 6B:
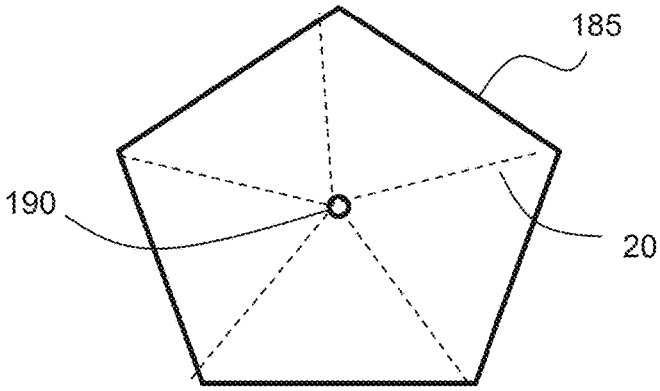
FIG. 6*b* is a bottom plan view of an inner covering in accordance with some embodiments of the presently disclosed subject matter.
Figure 6C:
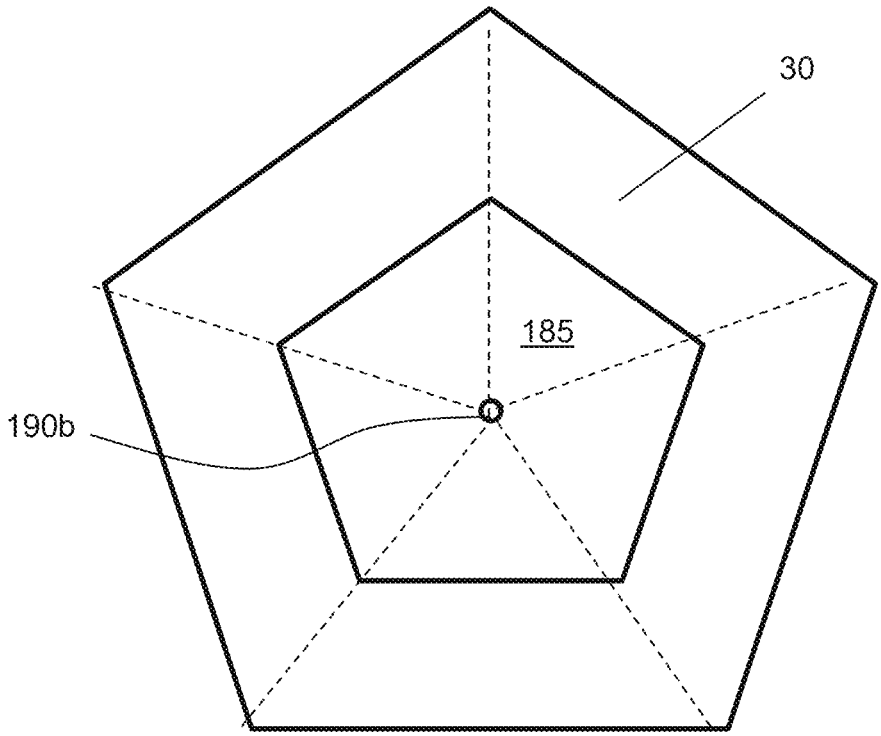
FIG. 6*c* is a bottom plan view of an inner covering and canopy in accordance with some embodiments of the presently disclosed subject matter.

FIG. 6*b* illustrates one embodiment of inner covering 185 positioned to surround the light source chamber to block direct light to the user. The inner covering includes an inner surface (e.g., the surface facing light source 60) that can include reflective material to reflect light off the reflective inner portion of the umbrella hood to ensure maximum light deliverance. FIG. 6*b* illustrates inner covering 185 comprising interior opening 190 for accommodating illuminator 35. The inner covering can be maintained in positioned by cooperating with one or more inner ribs 20 using any conventional mechanism, such as apertures, clips, fasteners, adhesive, and the like. The inner covering travels down the length of the inner ribs and circles inner covering nook 95. Thus, the inner covering can include first interior opening 190*a* to accommodate the illuminator, above the light source. The inner covering can further include second interior opening 190*b* that accommodates covering nook 95. Openings 190*a*, 190*b* align to accommodate the illuminator. FIG. 6*c* illustrates canopy 30 positioned around the inner covering.

In use, the user can open umbrella during rainy or bad weather to provide a covering. Specifically, the user can slide illuminator 35 in an upward direction along handle 10. The user can depress retractable hinge 36 to slide the illuminator into the top area of the umbrella, as shown in the embodiment of FIG. 6*a*. Hinge 36 can then maintain the illuminator in position. Inner ribs 20 and outer ribs 25 are fully extended, and inner covering 185 is expanded, shielding the light source from the user. Thus, light source 60 is maintained within the interior compartment formed by the inner covering. When the user desires to illuminate the area under the canopy, they simply initiate on/off button 150 in grip 15. Light source 60 is then illuminated. The light is extended through at least a portion of chambers 70, 71 to illuminate the area under the umbrella. In this way, the user is visible to cars and other pedestrians, and the surrounding environment is lit up.

When the user desires to use the umbrella as a flashlight, they can initiate the on/off button to illuminate light source 60. Light is then funneled to iris cover 105. The light enters the cover through opening 130 of lower segment 116. A user can then fully open, partially open, or close screen 127 of the adaptor by manipulating adjuster 127. When the screen is open and partially open, light flows through lens 110 and exits upper segment 115 via opening 131. The flashlight can then be used.

Optionally, the user can manipulate the intensity of the light that exits the illuminator using dimmer switch 65.

When the user desires to turn off the flashlight, they can simply close screen 127 using the adjuster. Alternatively or in addition, the user can manipulate on/off button 150 to the "off" position.

The umbrella can be folded to a storage configuration by sliding illuminator 35 down the length of handle 10. Particularly, retractable hinge 37 can be pressed into slot 37, allowing the illuminator to travel down the handle. As the illuminator travels down the umbrella, the inner and outer ribs fold inward, decreasing the surface area of canopy 30. The umbrella can then be stored for later use. In some embodiments, the light source can be charged during storage by exposing solar panels 155 to sunlight. Alternatively or in addition, the light source can be charged using batteries.

The disclosed umbrella offers many advantages over prior art umbrellas. For example, umbrella 5 provides light to a user, allowing the user to see in an area surrounding their path. In this way, trips and falls are reduced or avoided. Umbrella 5 is easy to use, such that even children or the elderly can manipulate the umbrella to use the illuminator.

Advantageously, the light source can be charged using solar power, which is cost effective and does not require replacement of batteries. The device can be used to charge any of a wide variety of electronics via a USB port, providing an added convenience for users. The umbrella can be conveniently held or hung by wristband 180, such that the user does not have to constantly carry the umbrella by the handle. The umbrella can be configured in a wide variety of sizes to accommodate both children and adults.

The presently disclosed subject matter is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications can be made to the embodiments described above without departing from the scope of the present invention, as defined by the appended claims.

What is claimed is:

1. An illuminating umbrella comprising:

an elongated handle comprising a first end, an opposed second end, an exterior, and an interior;

a folding radial frame positioned at the first end of the handle, the frame defined by a series of outer ribs and inner ribs;

a canopy extending over the frame, directly attached to the outer ribs;

a grip positioned at the second end of the handle, the grip defined by a bottom surface;

an illuminator positioned around the exterior of the handle within the folding radial frame and extending above the outer ribs, the illuminator being configured to move along a length of the elongated handle with the inner ribs between an extended position and a retracted position, the illuminator defined by:

first and second inner chambers, each comprising one or more sections that are transparent, opaque, or semi-transparent;

a light source positioned within the second chamber;

a top hinge positioned adjacent to a top edge of the first chamber;

an iris cover positioned above the radial frame including the inner and the outer ribs, the iris cover defined by upper and lower segments each comprising a central opening;

a lens aligned with the central openings;

a regulator comprising a window that that opens and closes a light path through the lens, aligned with the central openings;

a casing positioned adjacent to a lower end of the second chamber;

a lower hinge positioned adjacent to the casing;

a nook positioned adjacent to the lower hinge, the nook comprising a diameter that is less than a diameter of the lower hinge;

a base positioned adjacent to the nook, the base having a diameter that is greater than the diameter of the nook;

an inner covering that spans a distance extending from the inner ribs, across the illuminator at a level that is above the light source, down the length of the ribs to encircle the nook, thereby enclosing the light source.

2. The illuminating umbrella of claim 1, wherein the light source comprises one or more light emitting diodes.

3. The illuminating umbrella of claim 1, wherein the bottom surface of the grip comprises one or more solar panels configured to charge the light source.

4. The illuminating umbrella of claim 1, comprising batteries configured to charge the light source.

5. The illuminating umbrella of claim 1, wherein wiring extends from the light source through the interior of the handle to one or more batteries, solar panels, or both.

6. The illuminating umbrella of claim 1, wherein the interior surface of the first and second inner chambers comprises a reflective material.

7. The illuminating umbrella of claim 1, wherein the light source emits light in white, yellow, blue, red, green, orange, purple, or combinations thereof.

8. The illuminating umbrella of claim 1, further comprising a dimmer to adjust intensity of light emitting from the light source.

9. The illuminating umbrella of claim 1, wherein the first inner chamber is opaque, and all but a section of the second inner chamber is opaque.

10. The illuminating umbrella of claim 1, further comprising a USB port, mini-USB port, or both.

11. A method of illuminating the interior of an umbrella, the method comprising:

initiating the light source of the illuminating umbrella of claim 1;

extending the umbrella to a use configuration wherein the canopy is fully extended;

whereby light produced by the light source extends through at least a portion of the second inner chamber to illuminate the interior of the umbrella, under the canopy.

12. The method of claim 11, wherein the intensity of the light is adjusted by a dimmer switch positioned on the illuminating umbrella.

13. The method of claim 11, wherein the light source comprises one or more light emitting diodes.

14. A method of using a flashlight, the method comprising:

initiating the light source of the illuminating umbrella of claim 1;

retracting the illuminating umbrella to a storage configuration wherein the canopy and upper and lower ribs are fully folded;

opening the window of the regulator to allow light to pass from the light source, through the interior of the first and second inner chambers, through the opening of the iris covering, through the lens, and to exit the iris cover;

wherein the light that exits the iris cover functions as a flashlight beam.

15. The method of claim 14, wherein the intensity of the light beam can be adjusted using an adjustment positioned in the iris covering.

* * * * *